United States Patent [19]

Geiger

[11] Patent Number: 4,819,874

[45] Date of Patent: Apr. 11, 1989

[54] FLOATING ROCK ISLAND FOUNTAINS

[76] Inventor: Emery A. Geiger, 1340 East Wilshire Avenue, Santa Ana, Calif. 92705

[21] Appl. No.: 78,526

[22] Filed: Jul. 28, 1987

[51] Int. Cl.[4] ..... B05B 17/08

[52] U.S. Cl. ..... 239/23; 239/211; 239/587; 239/600

[58] Field of Search ..... 239/17–23, 239/211, 289, 587, 588, 600

[56] References Cited

U.S. PATENT DOCUMENTS

| | | | |
|---|---|---|---|
| 2,248,386 | 7/1941 | Richardson | 239/17 |
| 2,827,268 | 3/1958 | Staaf | 239/17 |
| 3,030,028 | 4/1962 | Hruby, Jr. | 239/17 |
| 3,101,173 | 8/1963 | Jennings | 239/23 |
| 3,318,528 | 5/1967 | Williams | 239/17 |
| 3,722,816 | 3/1973 | Stewart et al. | 239/17 |
| 3,869,087 | 3/1975 | Erickson | 239/23 |
| 4,088,880 | 5/1978 | Walsh | 239/18 |
| 4,174,808 | 11/1979 | Latin | 239/23 |
| 4,416,420 | 11/1983 | Thompson | 239/22 |

FOREIGN PATENT DOCUMENTS

| | | | |
|---|---|---|---|
| 70768 | 8/1893 | Fed. Rep. of Germany | 239/23 |

*Primary Examiner*—Andres Kashnikow
*Assistant Examiner*—Michael J. Forman
*Attorney, Agent, or Firm*—Whann & Connors

[57] ABSTRACT

Disclosed is an apparatus for circulating water in a body of water including a simulated floating rock structure connected to a pump located remote from the body of water. Conduits place the pump, the body of water, and rock structure in communication so that water is drawn from the body of water and forced under pressure through the conduit connected to the floating rock structure. There is a nozzle element in the floating rock structure centrally located in the top of the floating rock structure connected to the conduit leading from the outlet of the pump so that water under pressure is forced through this nozzle. The conduit connected to the floating rock structure includes a slidable section that automatically increases or decreases the length of the conduit as the water level changes within the body of water. Valves are provided to control the flow of water so that the spray emanating from the nozzle element may be increased or decreased.

6 Claims, 3 Drawing Sheets

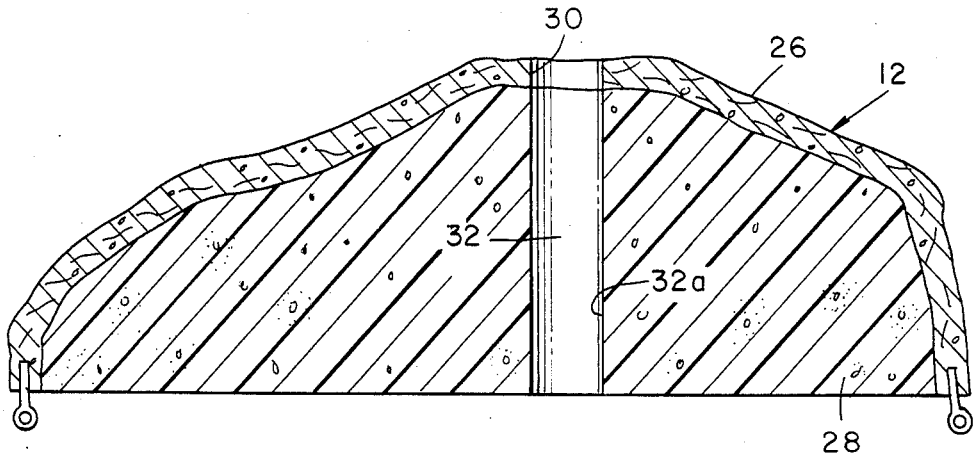
FIG. 3
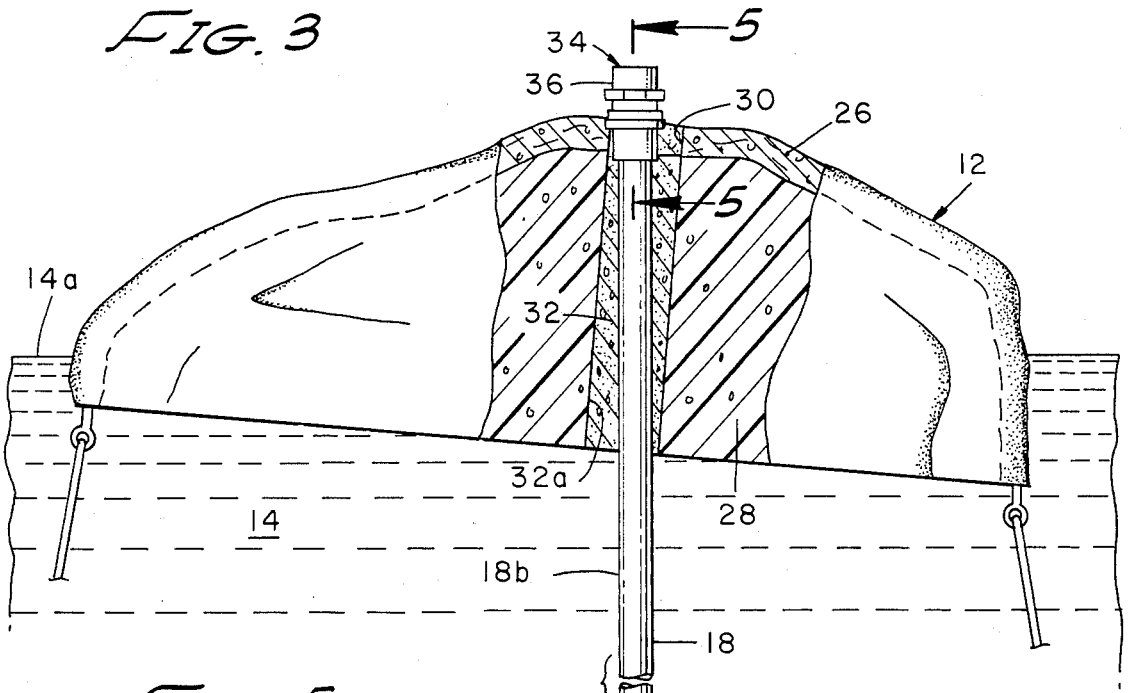
FIG. 4
FIG. 5
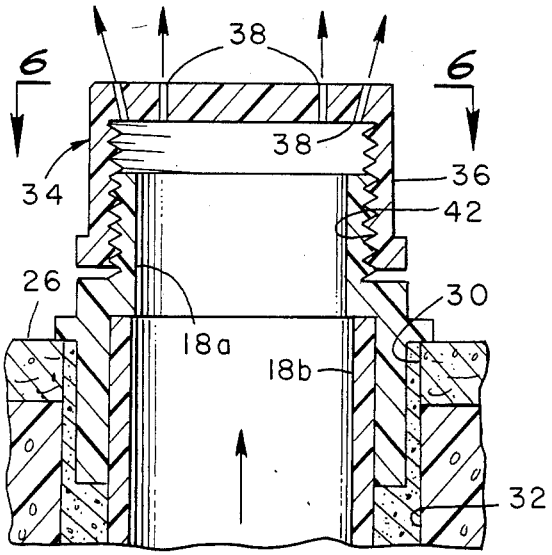
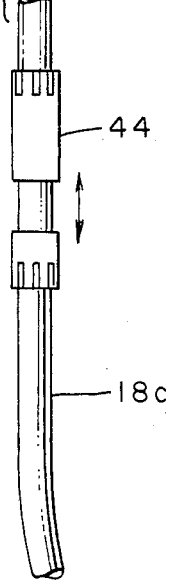

FLOATING ROCK ISLAND FOUNTAINS

BACKGROUND OF THE INVENTION

1. Field of the Invention

This invention relates to an apparatus for circulating water in a body of water, and particularly to an apparatus which employs a simulated rock structure fountain that floats on the surface of the body of water.

2. Background Discussion

Small bodies of water such as artificial lakes and the like often require the use of devices to aerate the water to prevent the build of bacteria. Many of these devices are unattractive, and furthermore, do not do an adequate job of aerating the water. Moreover, these devices are expensive to manufacture, install, and maintain. It is the objective of the present invention to provide an apparatus for circulating water within a small body of water which is easy to install, is attractive in appearance, and effectively circulates and aerates the water.

SUMMARY OF THE INVENTION

The present invention provides an apparatus for circulating water within a small body of water which meets the above objectives. There are several features of this invention which contribute to its ease of installation, attractive appearance and effective circulating and aeration, no single one of which is solely responsible for these desirable attributes. Without limiting the scope of this invention as expressed by the claims, its more prominent features will now be discussed briefly. After considering this discussion, and particularly after reading the section of this application entitled "DETAILED DESCRIPTION OF THE PREFERRED EMBODIMENT", one will understand how the features of this invention provide its desirable attributes.

The first feature of this invention is the use of a simulated rock structure adapted to float on the surface of the body of water to hold a nozzle element through which circulated water is pumped. Preferably, the rock structure is fabricated from a polymeric material which has embedded in its surface rock particulates that gives the exterior surface of the simulated rock structure the appearance of natural rock. This structure is hollow and filled with foam so that it floats. Preferably, the nozzle element is centrally located in the top of the rock structure and connected to a pipe element which runs through the body of the simulated rock structure downwardly into a conduit below the surface of the body of water.

The second feature is the use of a pump remotely located from the body of the water, preferably along the shore line, which enables the pump to pump water from a body of water to the nozzle. The pump has a water inlet and a water outlet, and flexible submersible conduits are connected to the inlet and outlet. The conduit connected to the water inlet preferably has a filter attached to it and may also include a T-shaped water collector having two open and opposed ends through which water is drawn. The conduit connected to the water outlet of the pump includes valves for regulating the flow of water through this conduit. The greater the amount of water flowing through the conduit into the nozzle element, the higher will be the spray of water from the nozzle element. By reducing this flow, the height of the nozzle spray may be selectively lowered.

The third feature of this invention is the use of a plurality of simulated rock structures connected by separate conduits to the outlet of the pump. Thus, using a single pump two or more floating rock structures can be placed in a single body of water.

The fourth feature of this invention is the use of slip fittings in the conduits leading to the nozzle elements. The slip fittings permit the conduits to increase or decrease in length to accommodate changing water levels in the body of water. Thus, if the water level increases, the conduit length will automatically increase. Conversely, if the level of water decreases, the conduit length will shorten.

The fifth feature of this invention is to complete filling the simulated rock structure with foam after it has been floated on the surface of the body of water. Preferably, the simulated rock structure has an enlarged central passageway extending through it that allows the conduit conducted between the nozzle and the water outlet of the pump to pass through it without touching the side wall of the passageway. Thus, a clearance is provided that allows the simulated rock structure to float and assume an equilibrated position, moving the conduit relative to the passageway. Once the simulated rock structure has assumed an equilibrated position, the passageway is filled with foam to hold the conduit in position so that the simulated rock structure no longer is able to move relative to the conduit.

The preferred embodiment of this invention illustrating all of its features will now be discussed in detail. This preferred embodiment is illustrative of the invention and not intended to limit it.

BRIEF DESCRIPTION OF THE DRAWING

The drawing, wherein like numerals indicate like parts, depicts the preferred embodiment of this invention, in which:

FIG. 3 is a cross-sectional view of one of the simulated rocks used in this invention prior to insertion of a conduit there through.

FIG. 4 is a cross-sectional view through the simulated rock shown in FIG. 3 with a conduit in place.

FIG. 5 is a cross-sectional view taken along line 5—5 of FIG. 4.

DESCRIPTION OF THE PREFERRED EMBODIMENT

Figure 1:
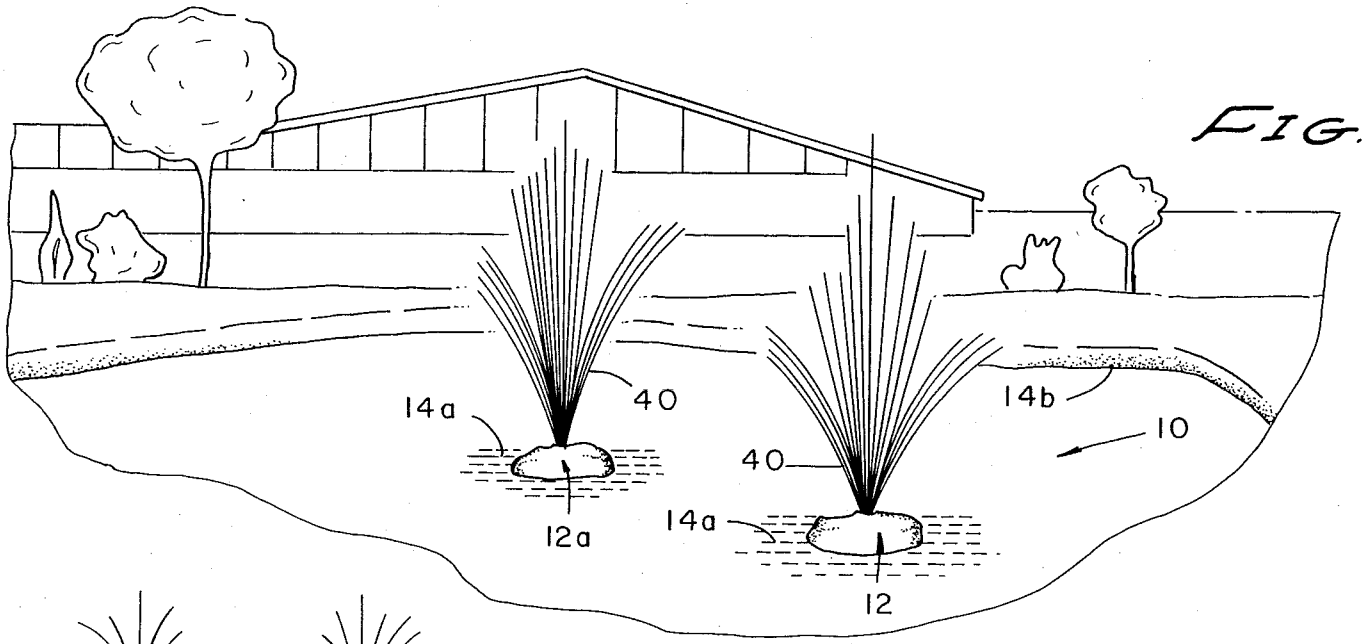
FIG. 1 is a perspective view showing the floating rock fountain and the circulator of this invention.
Figure 2:
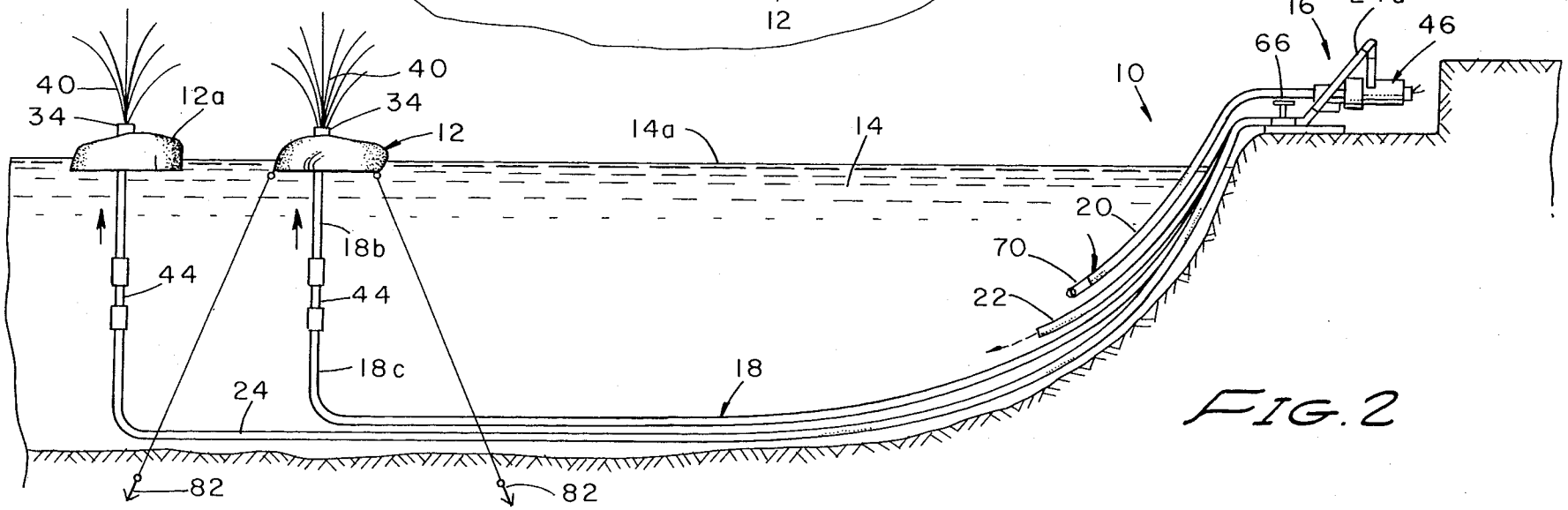
FIG. 2 is a cross-sectional view of the floating rock fountain and circulator of this invention.

As best illustrated in FIGS. 1 and 2, the apparatus 10 of this invention includes a simulated rock structure 12 which is adapted to float on the surface 14*a* of a body of water 14, a pumping station 16 remote from the body of water, preferably along the shoreline 14*b* of the body of water, and conduits 18, 20, 22, and 24 used to circulate water between the body of water and the simulated floating rock structure. Two rock structures 12 and 12*a* are illustrated in this embodiment although one or several more could be employed.

As best shown in FIGS. 3 and 4, the simulated floating rock structure 12 includes a shell 26 filled with foam 28. The shell 26 is made of a polymeric material which has an exterior surface simulating a rock and consisting of a plurality of small particulates of rock embedded into the polymeric material. A fiberglass reinforcing sheath is embedded to the opposite side of this shell. Suitable shells may be purchased from Rock and Waterscape Systems, Inc. of California.

To form the simulated floating rock structure 12 the shell 26 is filled with foam. A suitable foam may be obtained from Universal Foam Systems, Inc. of Cudahy, Wisconsin. Preferably the central top part of the shell 12 has an opening 30 drilled in it and this opening is opposite a central passageway 32. The passageway 32 is formed by placing a tubular member (not shown) in position opposite the opening 30 prior to filling the shell 26 with foam. This prevents the foam from filling the space occupied by the tube to thus form the passageway 32. As will be explained in greater detail below, this passageway 32 permits the conduit 18 connected to a nozzle 34 to pass through the floating rock structure 12 with a substantial clearance between the passageway wall 32*a* and the conduit 18 so that the floating structure may move relative to the conduit during installation.

The nozzle 34 connected to the conduit 18 passing through the passageway 32 simply includes a cap 36 that has a plurality of holes 38 (FIG. 6) located in its top surface at various angles relative to each other so that, when water is forced through the nozzle, a generally conical spray 40 issues forth from the nozzle as illustrated in FIG. 1. As shown in FIG. 5, the internal surface 42 of the cap 36 has a thread which enables the cap to be screwed onto the threaded end 18*a* of the conduit 18 passing through the floating rock structure 12. A downwardly projecting conduit section 18b extends into the body of water 14 and has a slip fitting 44 attached to its which connects with a conduit section 18c that leads to the pumping station 16. This slip fitting 44 is of the type depicted in U.S. Pat. No. 3,971,574. Such a slip fitting 44 will enable the two conduit sections 18b and 18c to move relative to one another so that, as the level of water changes, the overall length of the conduit 18 will either increase or decrease depending on the water level.

Figures 6, 7:
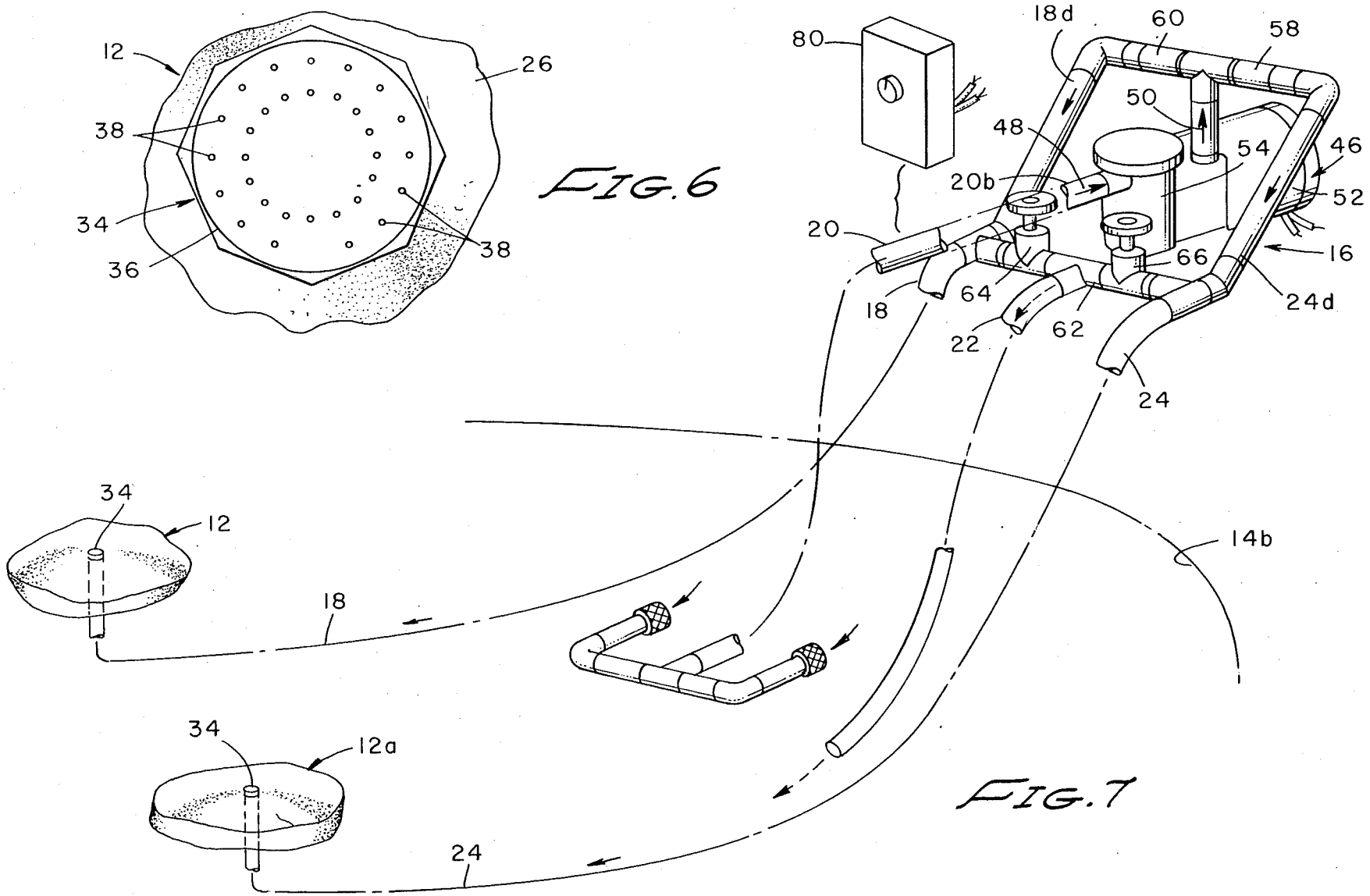
FIG. 6 is a cross-sectional view taken along line 6—6 of FIG. 5.
FIG. 7 is a perspective view of the pump and conduits used in this invention.

As best shown in FIG. 7, a pump 46 is used to force water under pressure through the nozzle 34. The pump 46 has an inlet end 48 and an outlet end 50 and may be of the conventional impeller type driven by an electric motor 52. The water inlet conduit 20 is connected to the water inlet end 48 of the pump 46. This conduit 20 has one end 20*a* immersed in the body of water 14 and another end 20*b* connected to a rock catcher 54 which is disposed at the pump inlet 48. The end 20*a* of the conduit immersed in the water has screen filters 56 attached to it. Thus, water being drawn into the inlet of the pump 46 is filtered to remove particulates that might clog the conduits or interfere with the operation of the pump.

The outlet of the pump has two discharge terminals 58 and 60. One discharge terminal 58 is connected through a conduit sections 24d to one simulated rock structure 12*a*. The other discharge terminal 60 is connected to the second simulated floating rock structure 12 through the conduit structure 18*d*. There is a line 62 connected between the two conduit section 24*d* and 18*d* which includes an outlet conduit 22 that discharges water into the body of water. The line 62 has two control valves 64 and 66 which control the flow of water through the discharge conduit 22. With these valves 64 and 66 closed, all of the water is diverted equally to the two floating rock structures 12 and 12a and pumped respectively through the conduits 18 and 24 to the nozzles 34 of these structures. By opening one or both of these valves completely or partially, the flow of water is diverted through conduit 22 to either increase or decrease the height of the spray 40 emanating from the nozzles 34.

As depicted in FIG. 7, the intake end 70 of the conduit 20 may be in the form of a T-shaped section 72 with the cross 72a of the "T" having two open ends 74 with the filters 56 thereat that permit water to be drawn into the intake end in two separate locations in the body of water. The leg 76 of the T-shaped scetion 72 is centrally located and has its open end connected to the water inlet 48 of the pump 46. Such a T-shaped section 72 is used in very shallow bodies of water. It enables the water to be drawn into the pump 46 without unduly agitating the body of water 14.

The preferred conduit is made of polyvinylchloride and is either a flexible pipe or hose. A two horsepower pump pumping 180 gallons of water per minute is suitable for most applications. This pump can be connected to an electrical control panel 80 with a 24-hour timer that will automatically turn the pump on and off.

INSTALLATION AND OPERATION

To install the apparatus of this invention, one first places the simulated floating rock structures 12 and 12*a* in the desired location on the surface 14*a* of the body of water 14 and then, employing anchors 82 (FIG. 2), connects the structures to the anchors to locate the structures in a preselected spot on the surface 14*a* of the body of water. The conduits 20, 18, and 24 are connected, respectively, to the inlet 48 and outlet body 50 of the pump 46 which has been placed on the shoreline 14*b* and connected to an electric power source. The conduits 18 and 24 are submerged in the body of water 14 and directed to the desired floating rock structure with a 90 degree approximate bend being made at the point where the conduit is inserted through the passageway 32 in the floating rock structure. The section of the conduits 18 and 24 which pass through the floating rock structures 12 and 12*a* extend through the central openings 30. Since there is sufficient clearance between the passageway wall 32*a* and the conduit section, the floating rock structure will freely float on the surface 14*a* of the water and assume an equilibrated position as shown in FIG. 4. Consequently, the passageway 32 is not necessarily parallel to the conduit section but may be at a slight angle relative thereto. This is acceptable and will normally occur. The conduit section, however, is generally at 90 degrees relative to the horizontal. With the conduit section in this position, the passageway 32 is filled with foam so that the conduit is not able to move relative to the floating rock structure. The cap 36 of the nozzle 34 is then secured to the end of the conduit section protruding from the floating rock structure 12.

With the conduit 20 connected as illustrated in FIG. 7, and the pump 46 operating, water is drawn through the open ends 74 through the filters 56 into the conduit 20 to the rock catcher 54 and then in the inlet end 48 of the pump 46 and then out the outle end 50 into two discharge terminals 58 and 60 flowing respectively through conduits 18 and 24 out of the nozzles 34 to provide the conical sprays 40 emanating from the central top portion of the floating rock structures 12 and 12*a*. By adjusting the position of the valves 64 and 66, water can be divided through these valves to the discharge conduit 22 to lower the height of the sprays 40. Since water is being continually drawn from the bottom of the body of water 14 and sprayed out the nozzles 34, it is simultaneously being aerated and recirculated. Since the pump 46 is not submersed in the body of water 14, it is easy to access for maintenance and repair as well as adjusting the time cycle of the timer.

The simulated floating rock structures 12 and 12*a*, conduits 18, 20, 22 and 24, pump 46, and filters 56 are all portable and readily assembled on site so that the apparatus 10 is easy to install or remove. The valves 64 and 66 permit one to adjust the height of the spray 40 which is highly desirable and may be required depending upon the location of the installation of the apparatus 10.

SCOPE OF THE INVENTION

The above description presents the best mode contemplated of carrying out the present invention as depicted by the preferred embodiment disclosed. The combination of features illustrated by this embodiment provides ease of installation, pleasing appearance, and effective circulation and aeration of water. This invention is, however, susceptible to modifications and alternate constructions from the embodiment shown in the drawing and described above. Consequently, it is not the intention to limit it to the particular embodiment disclosed. On the contrary, the intention is to cover all modifications and alternate constructions falling within the scope of the invention as generally expressed by the following claims.

I claim:

1. Apparatus for circulating water within a body of water, comprising:

a portable simulated rock structure adapted to float on the surface of the body of water and including a nozzle element above said surface, pumping means remote from the body of water having a water inlet and a water outlet, and submersible conduit means for connecting the water inlet of the pumping means to the body of water and for connecting the outlet of the pumping means to the nozzle element so that the water is drawn from the body of water and forced under pressure through the nozzle element, said conduit means including a conduit section that increases and decreases in length to accommodate changing water levels in the body of water, control means for varying the flow of water to the nozzle element, and said simulated rock structure, conduit means, and pumping means being adapted to be assembled on location, the simulated rock structure has therein a centrally located passageway wherein a conduit section passes therethrough and is connected to the nozzle element, said passageway providing a substantial clearance between the conduit section passing therethrough to allow the simulated floating rock structure while floating on the surface of the water to move relative to the conduit section in the passageway and assume a equilibrated position, whereupon the passageway is filled with foam material to hold the conduit section in a fixed position relative to the floating rock structure.

2. The apparatus of claim 1 including filter means in the conduit means upstream of the water inlet of the pumping means.

3. The apparatus of claim 1 including anchor means attached to the simulated rock structure for maintaining the simulated rock structure in one location on the surface of the body of water.

4. The apparatus of claim 1 wherein there are a plurality of simulated rock structures connected to a single pumping means.

5. The apparatus of claim 1 wherein the conduit means connected to the water inlet has a generally T-shaped configuration with opposed open ends of the arm of the "T" being in communication with the body of water and the open end of the leg of the "T" being connected to the water inlet.

6. Apparatus for circulating water within a body of water, comprising a simulated rock structure adapted to float on the surface of the body of water including a nozzle element above said surface, said simulated rock structure having therein a centrally located passageway wherein a conduit section passes therethrough and is connected to the nozzle element, said passageway providing a substantial clearance between the conduit section passing therethrough to allow the simulated floating rock structure while floating on the surface of the water to move relative to the conduit section in the passageway and assume an equilibrated position, whereupon the passageway is filled with foam material to hold the conduit in a fixed position relative to the floating rock structure, and pumping means remote from the body of water having a water inlet and a water outlet, and submersible conduit means for connecting the water inlet of the pumping means to the body of the water and for connecting the outlet of the pumping means to the nozzle element so that the water is drawn from the body of water and forced under pressure through the nozzle element.

* * * * *